US007857305B2

(12) United States Patent
Sokolowski

(10) Patent No.: US 7,857,305 B2
(45) Date of Patent: Dec. 28, 2010

(54) COLLAPSIBLE GRIPPERS BASED MEDIA HANDLING TRANSPORT APPARATUS WITH PROCESS AND CROSS-PROCESS DIRECTION REGISTRATION

(75) Inventor: Piotr Sokolowski, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 195 days.

(21) Appl. No.: 12/233,887

(22) Filed: Sep. 19, 2008

(65) Prior Publication Data

US 2010/0072697 A1 Mar. 25, 2010

(51) Int. Cl.
*B65H 29/04* (2006.01)

(52) U.S. Cl. ..... 271/204; 271/277; 271/85; 198/803.7; 198/803.1

(58) Field of Classification Search ..... 271/252, 271/277.234, 236, 243, 227, 228, 204, 82, 271/85; 198/803.7, 803.1
See application file for complete search history.

(56) References Cited

U.S. PATENT DOCUMENTS 4,069,728 A * 1/1978 McCrea ..... 83/409
4,276,978 A * 7/1981 Deguchi et al. ..... 198/803.1
4,807,867 A * 2/1989 Lippold et al. ..... 271/277
4,972,234 A 11/1990 Tanaka et al.
5,425,837 A * 6/1995 Hansch ..... 156/536
6,293,544 B1 9/2001 Fedinatz
6,478,297 B1 * 11/2002 Messerschmid ..... 271/277
2006/0108061 A1 * 5/2006 Winter et al. ..... 156/265

* cited by examiner

*Primary Examiner*—Stefanos Karmis
*Assistant Examiner*—Ernesto Suarez
(74) *Attorney, Agent, or Firm*—Ronald E. Prass, Jr.; Prass LLP

(57) ABSTRACT

This is a media transport apparatus using gripper segments that are connected to conveyor belts. These segments grip the leading edges of paper media and pull the media on a path toward a paper exit. Above the conveyor belts are baffle panels that have at least two panel separations. It is through these separations that the gripper segments move as the endless conveyor belts rotate. The gripper segments are provided with shifting structures that can laterally align the paper sheets. The leading edges of the paper are held between a gripper bar and elastomeric rollers.

7 Claims, 5 Drawing Sheets

COLLAPSIBLE GRIPPERS BASED MEDIA HANDLING TRANSPORT APPARATUS WITH PROCESS AND CROSS-PROCESS DIRECTION REGISTRATION

This invention relates to media or paper-handling systems and, more specifically, to a media transport system particularly useful in pre and post marking processes.

BACKGROUND

While the present invention can be used in any suitable marking system, it will be described herein for clarity as used in electrostatic marking systems such as electrophotography or xerography.

Marking systems that transport paper or other media are well known in the art. These marking systems include electrostatic marking systems, non-electrostatic marking systems, printers or any other marking system where paper or other flexible media or sheets are transported internally.

By way of background, in marking systems such as xerography or other electrostatographic processes, a uniform electrostatic charge is placed upon a photoreceptor belt or drum surface. The charged surface is then exposed to a light image of an original to selectively dissipate the charge to form a latent electrostatic image of the original. The latent image is developed by depositing finely divided and charged particles of toner upon the belt or drum photoreceptor surface. The toner may be in dry powder form or suspended in a liquid carrier. The charged toner, being electrostatically attached to the latent electrostatic image areas, creates a visible replica of the original. The developed image is then usually transferred from the photoreceptor surface to an intermediate transfer belt or to a final support material such as a paper sheet. When the paper is fed to the system from a paper stack of a feeder mechanism, some papers could be off the home position by many mm, and these fed paper sheets need to be deskewed and laterally registered option (1) into position upon placement on the transport belt or option (2) into position before contacting the image on the photoconductive surface. This is necessary because as the sheets move to the transfer station and approach the imaged photoconductor surface, they need to be in perfect alignment with the toned image on the photoconductive layer for proper image transfer to the sheet to take place. Also, many paper-moving systems are used for transporting printed sheets so they may be formed into books and the like. The present invention is useful in marking systems in both pre and post paper transport systems.

In the present system a number of sensors evaluate the positioning of the sheet as the paper sheet makes initial contact and when it continues down the transport path, and convey this information to a controller that will regulate and control progression of the sheet (including lateral registration) before it reaches the finishing station or the imaged photoconductive surface for image transfer to the sheet. In high speed marking systems, reaction and action time is important. Some prior art registration systems are too slow to be useful in today's high speed systems. The present invention allows for lateral reset while the paper lead edge is present in the gripper means.

In recent years, most of the media transport devices use nip rolls and a corresponding baffle system. Due to the nature of tolerance variations on those parts, there is slippage skew and walk observed which require an "in-line" additional registration subsystem to correct errors. Often these in line subsystems have been found to be inadequate.

SUMMARY

The present invention includes the use of multiple leading edge (LE) gripping segments comprised of two aligned registration collapsible rolling arms and corresponding partially centric bar. The LE gripping segments travel, synchronized by device timing on two timing belt conveyors. A buckled LE of the document in the gripping segment at the beginning of the transport is grasped between pairs of collapsible rolling arms and the bar. Those contacts provide enough force to maintain LE registration throughout transport until final release. The gripping segment delivers the document to the final destination, including but not limited to, exit transport nips or temporary/final compiling area in finishing devices. Cross-process registration of the acquired document is achieved by sliding of the gripping bar in transverse direction using a controlled relative, differential motion between two drivers along with the gripped document. Sensors and a controller with proper software provide the desired activation and control of this system.

The apparatus of the present transport assembly includes a laterally spaced flat bed baffle panels positioned over at least two conveyor belts. Attached to these belts via the spaces between the baffle sections are gripping bars that contact and hold the leading edge of the paper sheet in registration. During the initial advancement of the document, the document leading edge enters the buckling chamber defined between entrance baffles and then to the gripping bar and to the adjacent rolling elastomeric element of collapsible arms. Initially, the transport system stops at that first contact position to acquire and hold the leading edge of the sheet. The entire sheet is then transported by movement of the conveyor belts until it reaches its final destination where the gripping bar releases the document for further processing.

This invention provides a convenient, easy to use system for paper transport and paper registration. It features multiple lead edge gripper segments attached to inboard and outboard conveyor belts which are driven by a single motor. When the sheet is received, the transport is stationary and lead edge de-skew registration is accomplished with a buckle chamber. After LE registration is done, the acquisition of the sheet occurs by rolling the grippers over the top of the sheet using a curvature of the transport belts. At a time when the sheet(s) are transported, a second motor drives a center mounted conveyor belt. A differential position between the center belt and the outside belt provides in one embodiment a lateral motion to the sheet through a pin/follower/cam arrangement. This provides lateral sheet registration control. This is a convenient and effective mechanism for achieving lateral motion in a gripper bar transport.

DETAILED DISCUSSION OF DRAWINGS AND PREFERRED EMBODIMENTS

Figure 1:
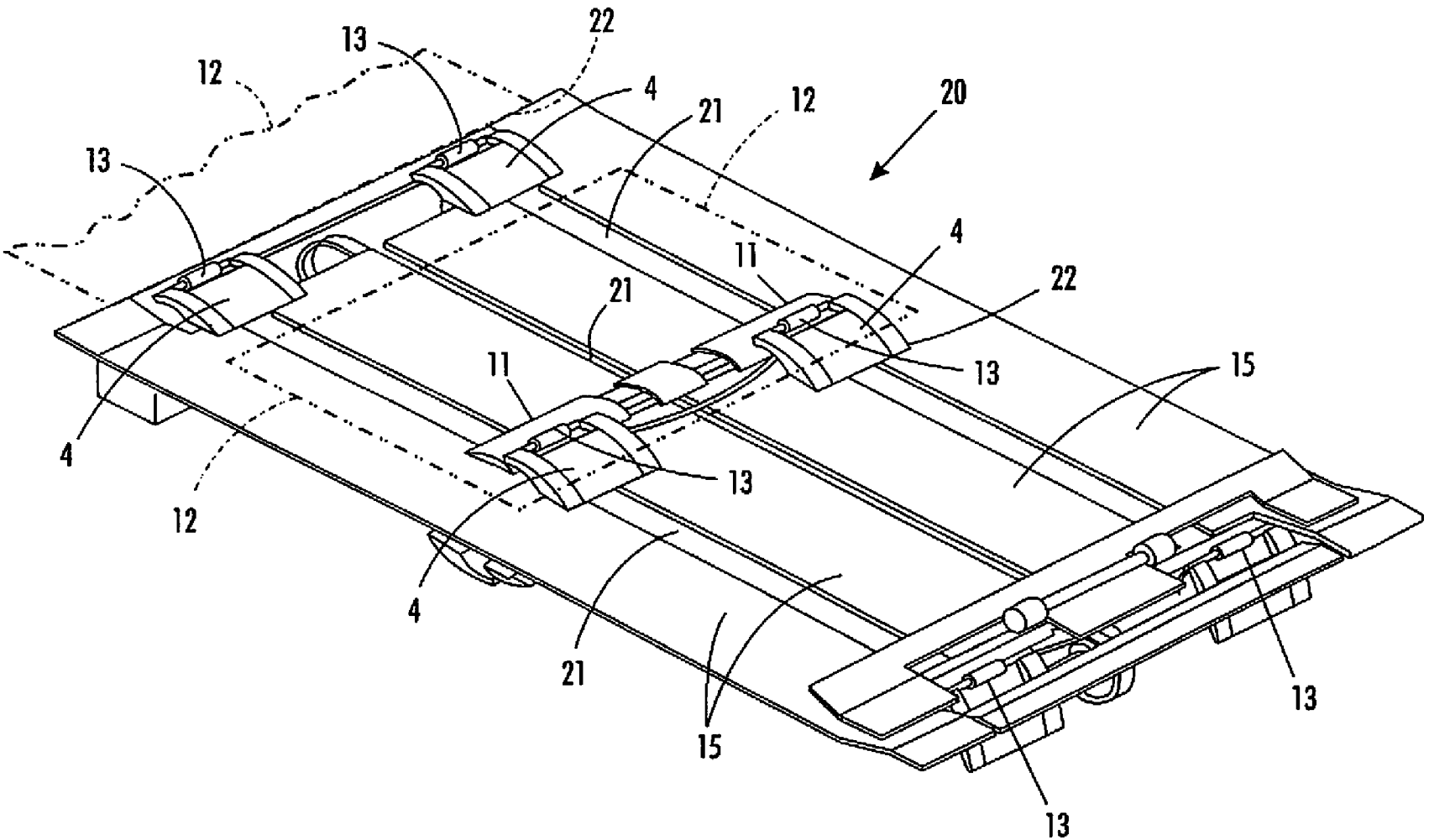
FIG. 1 is a top view of an embodiment of this invention showing the paper leading edge being held and transported by the moving gripper bars.

In FIG. 1, the document transport apparatus 20 is shown from a top side perspective. A separated main flat bed baffle 15 is shown with spaces 21 therebetween. The paper-gripping segments made up of gripper bars 11, roller arms 4 and gripping rollers 13 are attached to movable conveyor belts 14 (see FIG. 2) and travel along the length of baffle spaces 21 while holding the leading edge 22 of paper or media sheets 12. The gripper bars 11 and the lateral adjustment of gripper segments keep the document 12 in proper alignment/registration to the final destination 23. Motors 7 and 9 propel the gripper segments forward as the process occurs. Sensors 18 are located along a desired location in the system to convey information to a controller(s) 19 so that this controller can properly provide lateral adjustment and registration to bars 11 and forward movement to gripping segments 11, 13 and 4 until the paper sheet 12 reaches final destination 23. For clarity, in FIG. 1 paper sheet 12 is shown by dotted lines as its leading edge 22 is pulled along by gripping segments 11, 13, 4, and as sheet 12 first enters the initial buckling chamber 10.

Figure 2:
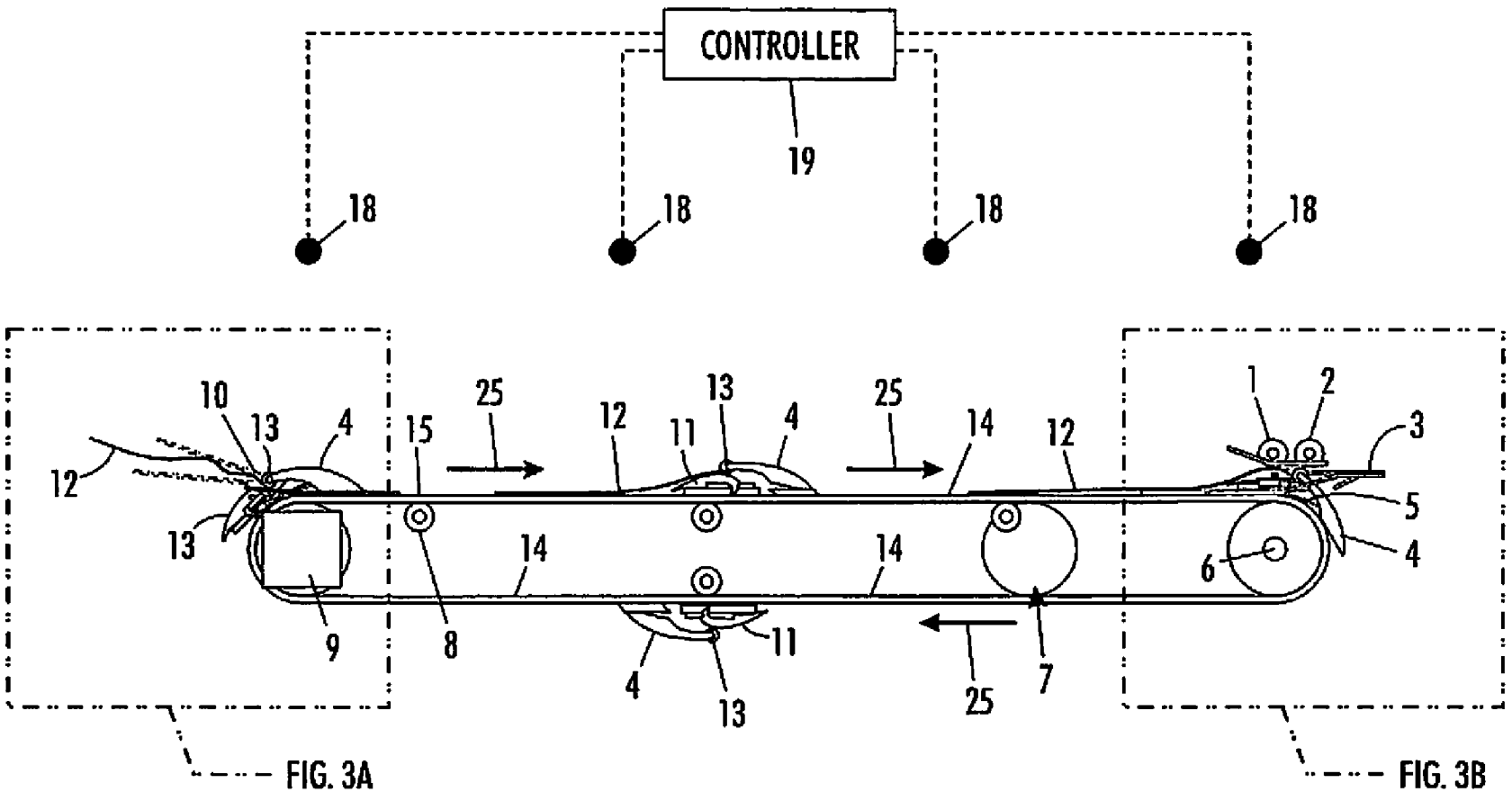
FIG. 2 is a side view of an embodiment of this invention illustrating the system components including the endless transport belt(s). Also shown are Details A and B of the beginning and end of this transport system.

In FIG. 2, the endless two conveyor belts 14 are shown as they move in the direction of arrows 25. Any number of sensors 18 is placed along the transport path to indicate the position of paper 12. A controller 19 is connected to the sensors 18 to properly control the process. Any number of sensors 18 is placed along the transport path to indicate the position of paper 12. A controller 19 is connected to the sensors 18 to properly control the process. During the initial advancement of the document 12, the front leading edge (LE) enters the buckling chamber 10 defined between entrance baffles, gripping bar 11 and rolling urethane elastomer element 13 of collapsible arms 24 where it is depicted in Detail A of FIG. 2. At that particular time, the transport stops at that desired position to acquire the document 12. Then, with a specified delay, motors 9 and 7 rotate the transport clockwise (CW)through acceleration to the desired velocity and timing of the apparatus. During that process, using the curvature (radius) of the drive rolls 13 and a proper spacing between the bar 11 and tensioned/pivoted arms 4, the rolling urethane elements 13 roll over the leading edge (LE) 22 of the document. The grip on the front of the document is provided by coefficient of friction (COF) of the bar 11 and rolls 13 through tensioning force of springs 5. COF of the bar 11 contact material and rolls 13 material have to be greater than 1.0 for the proper grip during acceleration/deceleration phases of the motion down the path.

With reference to Detail B of FIG. 2 when the document in the final stage of the transport enters exit rolls 1, the drive is maintained by the nip force between circular portion 6 of the bar 11 and rolls 13. At that time, using the curvature of the belts on pulleys, the arms 4 with rollers 13 roll off the bar 11 letting the LE of the document to propagate into next pick-up rolls 2 to exit the transport through a baffle 3.

Figure 3A:
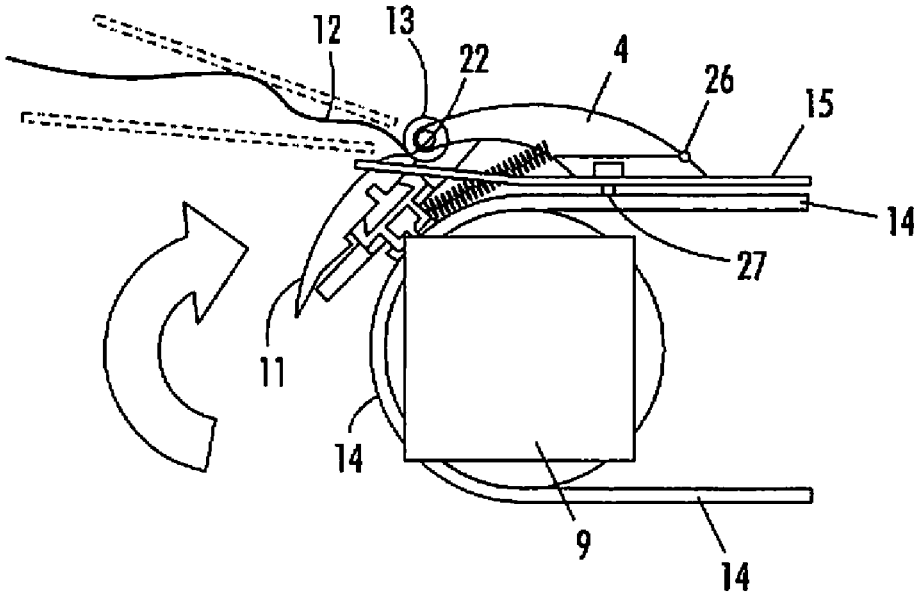
FIG. 3A is an exploded view of the Detail A of FIG. 2.

In FIG. 3A, an exploded view of Detail A of FIG. 2 is shown. A paper 12 is shown having its leading edge 22 being fed between gripper bar 11 and elastomeric roller 13. Tension arm 4 has a pivot point 26 which permits it to be spring loaded-moved depending upon the thickness of the paper or media 12. The paper leading edge 22 is securely held between gripper bar 11 and roller 13 and pulled over baffles 15 along the paper transport path by the moving conveyor belt 14 to which the gripper segment (made up of bar 11, roller 13 and roller pivot arm 4) is attached at attachment point 27. Endless conveyor belt 14 is moved forward by motor 9 which in turn moves the gripper segment(s) and the paper attached thereto. A spring 5 keeps the pivot arm 4 and roller 13 tightly against the paper leading edge 22. As the paper leading edge 22 enters the nip between roller 13 and curved gripper bar 11, the paper conforms to the curvature of gripper bar 11 and is conveniently and smoothly fed between bar 11 and roller 13.

Figure 3B:
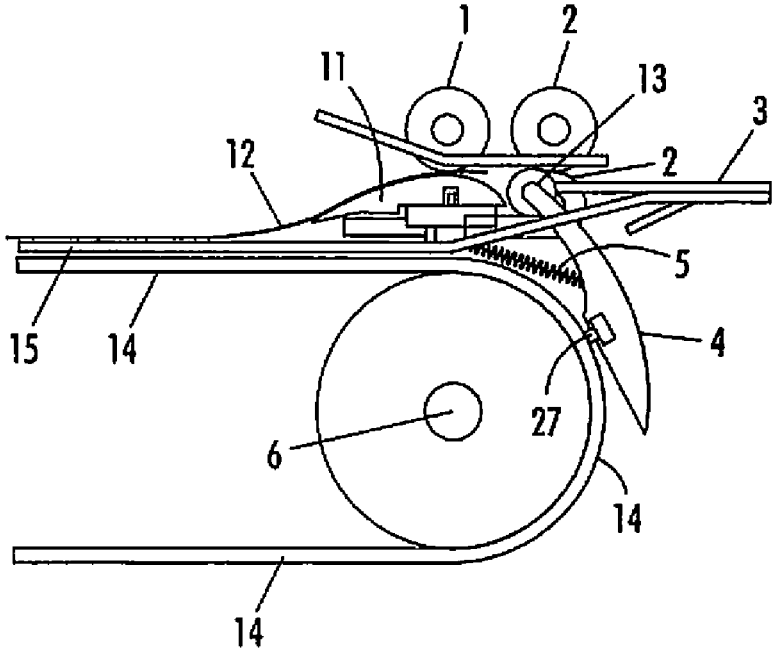
FIG. 3B is an exploded view of the Detail B of FIG. 2.

In FIG. 3B, Detail B of FIG. 2 is exploded for easier understanding. With reference to Detail B of FIG. 2, in one embodiment when the document 12 in the final stage of the transport enters exit rolls 1, the drive is maintained by the nip force between circular portion 6 of the bar 11 and rolls 1. At that time, using the curvature of the belts 14 on pulleys, the pivot arms 4 with rollers 13 roll off the bar 11 letting the leading edge LE of the document to propagate into next pick-up rolls 2 to exit the transport through an exit baffle 3. Obviously, any suitable exit configuration may be used in place of that depicted in FIG. 3B.

Figure 4:
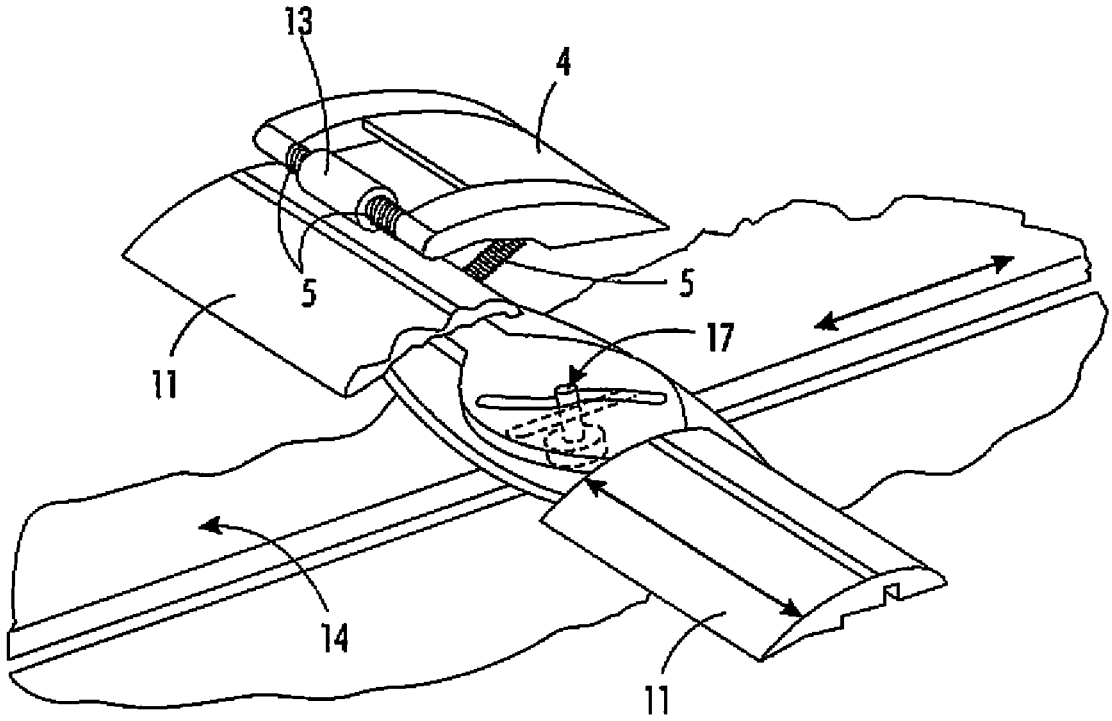
FIG. 4 is an exploded view of the shift bar and cam arrangement of one embodiment of this invention.

In FIG. 4, referring now, more particularly to FIG. 4, each document 12 is handled CW down the path is brought into cross process registration or offset position by shift of the bar 11 along with rollers 13 through a guiding pin/follower 17 attached to the belt 14 and a cam as a part of the bar 11. Using the edge position, sensor (not shown) and differential motion provided by a center drive motor system 7, the propagated document is being registered before it reaches the release station with exit nip rolls 1 and 2 and depicted in Detail B. The above-described cross process registration occurs during a time when neither document is being acquired nor released to the exit nips. After the nip release between circular portion 6 of the bar 11 and idler rolls 1 and before the next LE registration in 10, the bars 11 return to their original location. The central position of rollers 13 within arms 4 is provided by compression springs on both sides of the slide shaft.

Figure 5:
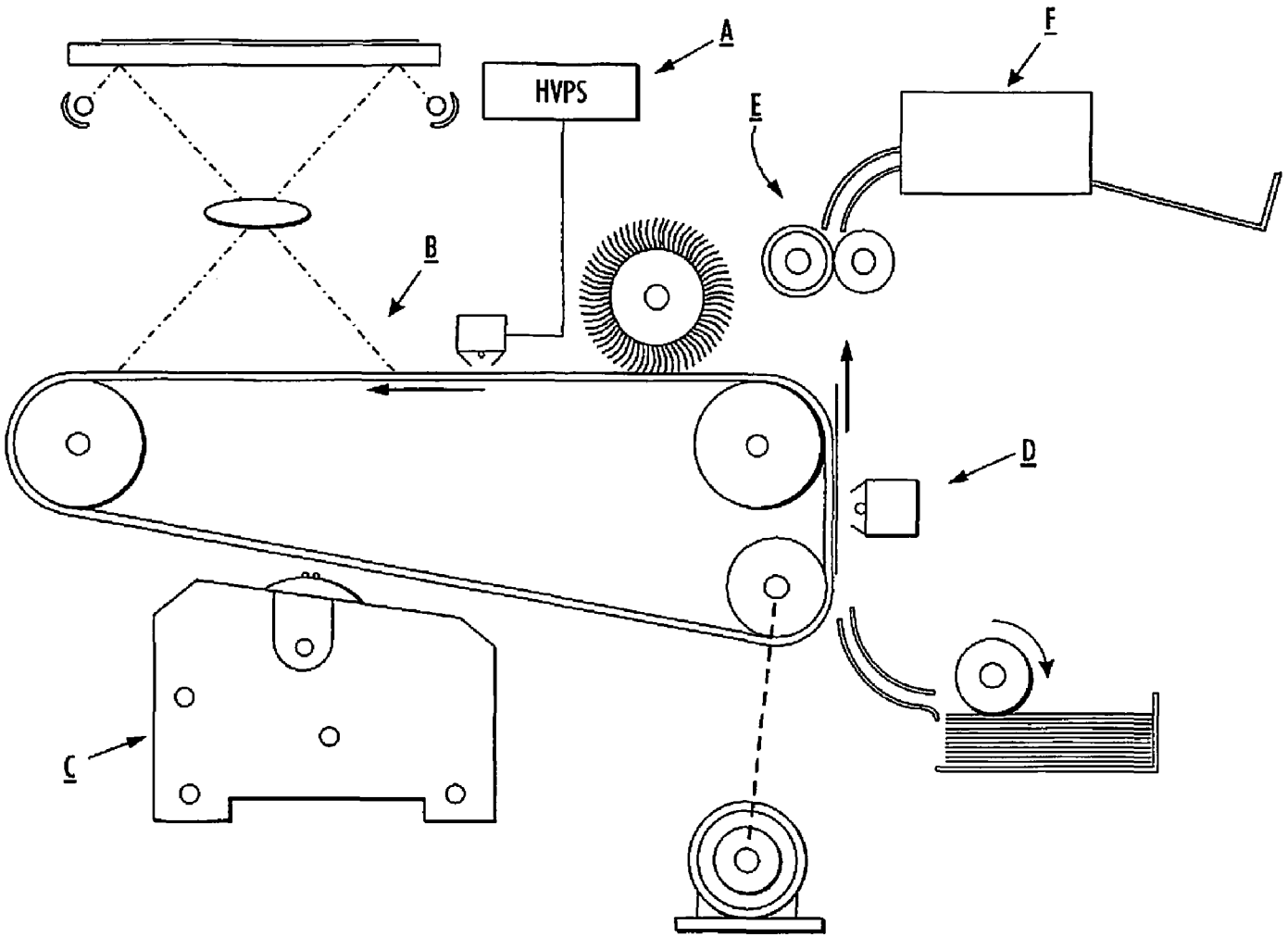
FIG. 5 is a typical xerographic marking system that can utilize the paper transport system of this invention.

In FIG. 5, a typical xerographic system is shown which can use the paper transport system of this invention. In FIG. 5, a xerographic marking system is illustrated. The paper transport system of the present invention can be used in this FIG. 5 marking system in either or both pre imaging and post imaging position. The present system can be used in any paper or media transport location of the entire FIG. 5 illustrated system including in the finishing apparatus or station F. In FIG. 5, the following component stations are depicted:

A. charge station
B. exposure station
C. development station
D. transfer station
E. fusing station
F. finishing station.

As noted earlier, a finishing station F may contain the transport apparatus of the present invention as may any other part of the illustrated marking system of FIG. 5.

It is believed that the foregoing description is sufficient for purposes of the present application to illustrate the general operation of a printing machine incorporating the paper transport apparatus of the present invention therein. Although the apparatus of the present invention is particularly well adapted for use in an electrophotographic reproducing machine, it will become apparent from the following discussion that the finishing apparatus of the present invention is equally well suited for use in a wide variety of printers and other non-marking document handling systems where conveyance of paper or other sheets is desired.

In summary, the present invention provides a sheet registration and conveyance system for transporting and registering these sheets via gripping of leading edges of these sheets. This system comprises at least one endless, movable conveyor belt, gripping segments attached to the conveyor belt(s), and baffle panels with separations positioned over an upper portion of these conveyor belt(s). The gripping segments are horizontally movable through these baffle separations while attached to said conveyor belt. The gripping segments comprise a gripper bar and a pivotable tension arm having an elastomeric roller(s) attached to its terminal portion. The gripper bar and the elastomeric roller are configured to securely hold a leading edge of the sheet and enabled to transport this sheet through a transport path from initial paper contact to an exit point for the paper sheet.

The gripper bar comprises an outside curved portion enabled to guide the sheet between the gripper bar and the elastomeric roller(s). The gripping segments are configured to be moved or shifted laterally and to be positioned in conformance with a desired paper or sheet exit location or position.

The tension arm is spring loaded to provide sufficient sheet-holding pressure on the elastomeric roller(s). The baffle panels are separated from each other to provide a space for each gripping segment to move therethrough while being connected to the endless movable conveyor belt. The leading edge is enabled to be gripped and released by the gripping segment, this gripping segment functions and is controlled via sensors and a controller connected to the system. A cross process registration or offset of the sheet is provided by differential speeds and horizontal shifting of the gripping segments. The conveyor belt is driven by a motor(s) and driving rolls in contact therewith, a speed of the conveyor belt and attached gripping segments is synchronized and determined by a system controller with appropriate pre-programmed software.

This invention provides an effective sheet registration and conveyance system for transporting and registering sheets via gripping of leading edges of the sheets. This system as above noted comprises two endless movable conveyor belts, at least two gripping segments attached to these conveyor belts and baffle panels with at least two panel separations positioned over an upper portion of said conveyor belts. The at least two gripping segments are horizontally movable through the baffle separations while both gripping segments are attached to different conveyor belts.

The gripping segments comprise a gripper bar and a pivotable tension spring loaded arm having two elastomeric roller(s) attached to its inboard terminal portions. The two gripper bars and the elastomeric roller are configured to securely hold a leading edge of the sheet and to transport this sheet through a transport path from initial leading edge paper contact to a paper sheet exit point. The gripping segments are enabled to slide in a transverse direction for cross process registration.

It will be appreciated that variations of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A sheet registration and conveyance system for transporting and registering along a transport path said sheets via leading edges of said sheets, said system comprising:

an endless movable conveyor belt on pulleys having a sheet entrance at a beginning of said transport path and a sheet exit point at an end of said transport path, at least two gripping segments attached to said conveyor belt, and baffle panels with separations positioned over an upper portion of said conveyor belt, said at least two gripping segments movable toward said sheet exit point through said baffle separations while said at least two gripping segments are attached to said conveyor belt, said gripping segments comprising a gripper bar and a spring loaded pivot arm having an elastomeric roller attached to its inboard terminal portion, said gripper bar and said elastomeric roller configured to securely hold a leading edge of said sheet therebetween and configured to transport said sheet through said transport path from initial leading edge paper contact to said sheet exit point, a curvature of said gripper bar and a spacing provided between said gripper bar and said pivot arm at initial paper contact enable said elastomeric roller to roll over said leading edge, and said system configured at said sheet exit using a curvature of said movable conveyor belt on pulleys to permit said pivot arm with said elastomeric roller to roll off said gripper bars releasing said sheet leading edge and permitting said sheet to exit said system at said exit point.

2. The system of claim 1 wherein said gripper bar comprises an outside curved portion enabled to guide said sheet between said gripper bar and said elastomeric roller, and configured at initial paper contact to permit said elastomeric roller to roll over said leading edge, and configured at said exit point to permit said sheet to roll off said gripper bar to exit said conveyance system.

3. The system of claim 1 wherein said pivot arm is pivotable and spring loaded to provide sufficient sheet-holding pressure on said elastomeric roller.

4. The system of claim 1 wherein said baffle panels are separated from each other to provide a space for each gripping segment to move therethrough while being connected to said endless movable conveyor belt.

5. The system of claim 1 wherein said leading edge is enabled to be gripped and released by said gripping segment, said gripping segment functions controlled via sensors and a controller connected to said system.

6. The system of claim 1 wherein said conveyor belt is driven by a motor and driving rolls in contact therewith, a speed of said conveyor belt and attached gripping segments is synchronized and determined by a system controller with sensors and pre-programmed software.

7. A xerographic marking apparatus having a sheet registration and conveyance system, said system comprising:

an endless movable conveyor belt on pulleys having a sheet entrance at a beginning of said transport path and a sheet exit point at an end of said transport path, at least two gripping segments attached to said conveyor belt, and baffle panels with separations positioned over an upper portion of said conveyor belt, said at least two gripping segments movable toward said sheet exit point through said baffle separations while said at least two gripping segments are attached to said conveyor belt, said gripping segments comprising a gripper bar and a spring loaded pivot arm having an elastomeric roller attached to its inboard terminal portion, said gripper bar and said elastomeric roller configured to securely hold a leading edge of said sheet therebetween and configured to transport said sheet through said transport path from initial leading edge paper contact to said sheet exit point, a curvature of said gripper bar and a spacing provided between said gripper bar and said pivot arm at initial paper contact enable said elastomeric roller to roll over said leading edge, and configured at said sheet exit using a curvature of said movable conveyor belt on pulleys to permit said pivot arm with said elastomeric roller to roll off said gripper bars releasing said sheet leading edge and permitting said sheet to exit said system at said exit point.

* * * * *